US008581498B1

(12) United States Patent
Cheung et al.

(10) Patent No.: US 8,581,498 B1
(45) Date of Patent: Nov. 12, 2013

(54) CONTROL OF BLEED CURRENT IN DRIVERS FOR DIMMABLE LIGHTING DEVICES

(75) Inventors: Eugene L. Cheung, Fremont, CA (US); David J. Chen, San Jose, CA (US); David C. Tournatory, San Francisco, CA (US)

(73) Assignee: Jade Sky Technologies, Inc., San Jose, CA (US)

( * ) Notice: Subject to any disclaimer, the term of this patent is extended or adjusted under 35 U.S.C. 154(b) by 152 days.

(21) Appl. No.: 13/370,884

(22) Filed: Feb. 10, 2012

Related U.S. Application Data

(60) Provisional application No. 61/442,611, filed on Feb. 14, 2011.

(51) Int. Cl.
*H05B 37/00* (2006.01)
*H05B 41/00* (2006.01)

(52) U.S. Cl.
USPC ..... 315/121; 315/119; 315/224; 315/291; 315/297

(58) Field of Classification Search
None
See application file for complete search history.

(56) References Cited

U.S. PATENT DOCUMENTS

| | | | | |
|---|---|---|---|---|
| 6,486,616 | B1 | 11/2002 | Liu et al. | |
| 2007/0121349 | A1 | 5/2007 | Mednik et al. | |
| 2008/0316781 | A1 | 12/2008 | Liu | |
| 2009/0251934 | A1 | 10/2009 | Shteynberg et al. | |
| 2010/0141173 | A1 | 6/2010 | Negrete | |
| 2010/0207536 | A1 | 8/2010 | Burdalski et al. | |
| 2011/0140620 | A1* | 6/2011 | Lin et al. | 315/224 |
| 2011/0140622 | A1* | 6/2011 | Suzuki | 315/224 |
| 2011/0193494 | A1 | 8/2011 | Gaknoki et al. | |
| 2012/0056553 | A1* | 3/2012 | Koolen et al. | 315/291 |

* cited by examiner

*Primary Examiner* — Anh Tran
(74) *Attorney, Agent, or Firm* — Radlo IP Law Group; Edward J. Radlo

(57) ABSTRACT

Methods and apparati for controlling bleed current (IBLEED) in a driver circuit (20) for a lighting device (23). A method embodiment of the present invention comprises the steps of coupling a dimmer (21) to an input of the driver circuit (20), and forcing the bleed current (IBLEED) to be inversely proportional to the time-averaged voltage (VLEDP) at said lighting device (23). The dimmer (21) consumes power even when the lighting device (23) is not emitting light.

20 Claims, 3 Drawing Sheets

CONTROL OF BLEED CURRENT IN DRIVERS FOR DIMMABLE LIGHTING DEVICES

RELATED APPLICATION

This patent application claims the benefit of commonly owned U.S. provisional patent application 61/442,611 filed Feb. 14, 2011 entitled "Variable Bleed Current for Triac-Dimmed LED Circuits", and is also related to U.S. patent application Ser. No. 13/110,724 filed May 18, 2011 entitled "Load Driver with Integrated Power Factor Correction", which two patent applications are hereby incorporated by reference in their entireties into the present patent application.

TECHNICAL FIELD

This invention pertains to the field of driver circuits for lighting devices, particularly LEDs, that employ the use of dimmers.

BACKGROUND ART

The use of high-brightness LEDs (light emitting diodes) in lighting applications is growing rapidly as a result of inherent benefits to LED technology such as long lifetimes, good efficiency, and the ability to use non-toxic materials. However, retrofitting existing applications with LED fixtures often requires compatibility with the large installed base of dimmers, particularly leading-edge triac-based dimmers. Because these dimmers were commonly designed for current levels much higher than those consumed by LED applications, many problems occur with existing LED driver solutions.

Triac-based dimmers function by allowing current to pass during a fraction of the half-cycle of the input AC mains voltage. One of the most common types of triac dimmers is the leading-edge type, which initially turns on at some point past the zero-crossing of the AC waveform (in both the upward direction and the downward direction), and then turns off at the next zero-crossing.

Most leading-edge triac-based dimmers were designed for use with incandescent light bulbs. In order to turn on and power the bulb, the triac requires a latching current to flow through the load. Subsequently, to maintain the triac's on state until the next AC zero-crossing, a lesser holding current must be present. This triac behavior matches well with the strongly positive temperature coefficient of incandescent bulbs. When cold and unpowered, an incandescent bulb presents a filament resistance which is a fraction of its value when powered. As current and power dissipation increase, temperature and hence resistance increase greatly. By its nature, the incandescent bulb provides a large latching current at the time of turn on, and maintains a lesser holding current while lit. Since one of the advantages of LED-based incandescent bulb replacements is power efficiency, it naturally draws less current than the hot incandescent bulb, and much less than the cold incandescent bulb.

When powered with triac-based dimmers, the performance of traditional LED driver ICs suffers in several ways. First, the driver efficiency generally falls well short of the desired targets. Even with the degraded efficiency due to a bleed of either constant current or constant resistance, many driver solutions fail in terms of gross functionality with digitally-controlled triac-based dimmers, which require low load impedance even in the standby state, when the dimmer is not explicitly powering the driver yet needs to keep standby circuits alive.

When trying to address these concerns, existing solutions can grow substantially in size, complexity, and power consumption. These concerns are addressed by the present invention.

DISCLOSURE OF INVENTION

Methods and apparati for controlling bleed current (IBLEED) in a driver circuit (20) for a lighting device (23). A method embodiment of the present invention comprises the steps of coupling a dimmer (21) to an input of the driver circuit (20), and forcing the bleed current (IBLEED) to be inversely proportional to the time-averaged voltage (VLEDP) at said lighting device (23). The dimmer (21) consumes power even when the lighting device (23) is not emitting light.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 1:
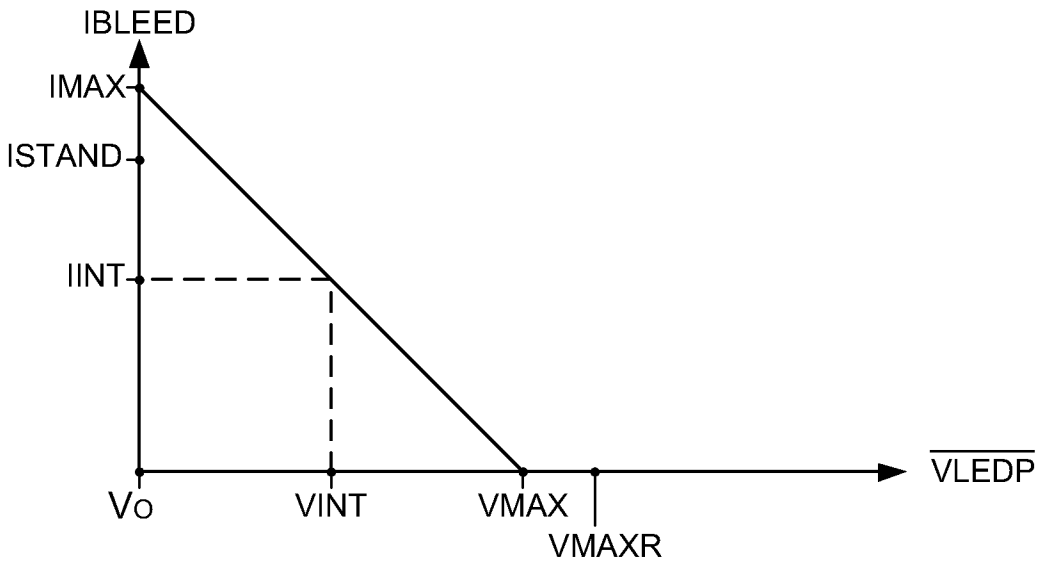
FIG. 1 is a graph of how the driver circuit 20 of the present invention controls the bleed current (IBLEED) as a function of the time-averaged voltage at the lighting device 23.

The present invention controls the bleed current IBLEED in the driver circuit 20, while maintaining excellent efficiency of the driver circuit 20 and accommodating many types of dimmers 21. Flicker and other unwanted manifestations in the lighting device 23 are avoided.

Our invention is particularly well-suited for lighting devices 23 that comprise one or several LEDs (light emitting diodes) 33, but the invention also has applicability where the lighting device 23 comprises one or more fluorescent light bulbs.

Dimmer 21 is typically a dimmer comprising a triac, a semiconductor that is a three-terminal device but is bidirectional, i.e., power can flow both ways through its power terminals. This is the most convenient way to dim in the present state-of-the-art. However, the present invention can be used with dimmers 21 other than those comprising triacs. Dimmer 21 is typically operated by a person, but it can also be programmed to automatically dim and brighten lighting device 23 using, for example, a pre-programmed software program. Dimmer 21 is typically rated for between 300 watts and 600 watts of power, whereas in the embodiment where lighting device 23 comprises one or more LEDs 33, lighting device 23 is typically rated for about 10 watts.

FIG. 1 shows a graph that is deemed desirable by the present invention. The graph shows IBLEED as a function of the time-averaged voltage (VLEDP) applied to the lighting device 23. As used herein, "time-averaged" means averaged (RC low-passed) over many cycles of the input AC waveform. We use time averaging because we want IBLEED to be steady (non-choppy) over time. In other words, we want to average out periodic line fluctuations. In FIG. 1, the horizontal bar across the letters VLEDP means "average".

The number of cycles in the time duration over which the averaging takes place must be greater than the frequency of changing the amplitude of dimmer 21, but less than the input AC frequency at input terminals LINE, NEUT. This AC line frequency is normally 60 Hz in the United States, but in other countries may be some other frequency, such as 50 Hz. The frequency of moving the amplitude of dimmer 21 is usually quite low, because dimmer 21 is normally activated by a human. However, as stated above, dimmer 21 can be activated by an automated means, in which case the amplitude of dimmer 21 can vary more rapidly than by human operation.

The graph in FIG. 1 does not have to be a straight line. For example, it could be curved, but for purposes of illustration, this specification describes the case where IBLEED as a function of voltage is a straight line.

We preselect IMAX (the maximum value of IBLEED, and the (BLEED that occurs at 0 volts) to be greater than the standby current (ISTAND) required by whatever dimmer 21 or dimmers 21 we plan to use in conjunction with the driver circuit 20 and lighting device 23. In general, the lower the quality of the dimmer 21, the higher its standby current will be, and therefore the higher we need IMAX to be.

We preselect VMAX, the voltage where IBLEED is zero, to be less than the maximum input voltage applied to circuit 20, i.e., the voltage when dimmer 21 is turned up to its maximum amplitude. VMAX is typically less than the voltage VMAXR where the LEDs 33 achieve full brightness. Finally, the third criterion that we satisfy is that the bleed current IINT present at some intermediate voltage VINT where the dimmer 21 needs to latch and hold (stay on) must be sufficient to enable said dimmer 21 to latch and hold, to avoid flicker from the lighting device 23.

An advantage that the graph of FIG. 1 has over the prior art is that the reduced bleed current IBLEED at the higher voltages allows for a higher IMAX and IBLEED in general at the lower voltages, without the penalty of higher power consumption, since bleed circuit power consumption is the simultaneous product of bleed current and voltage.

Figure 2:
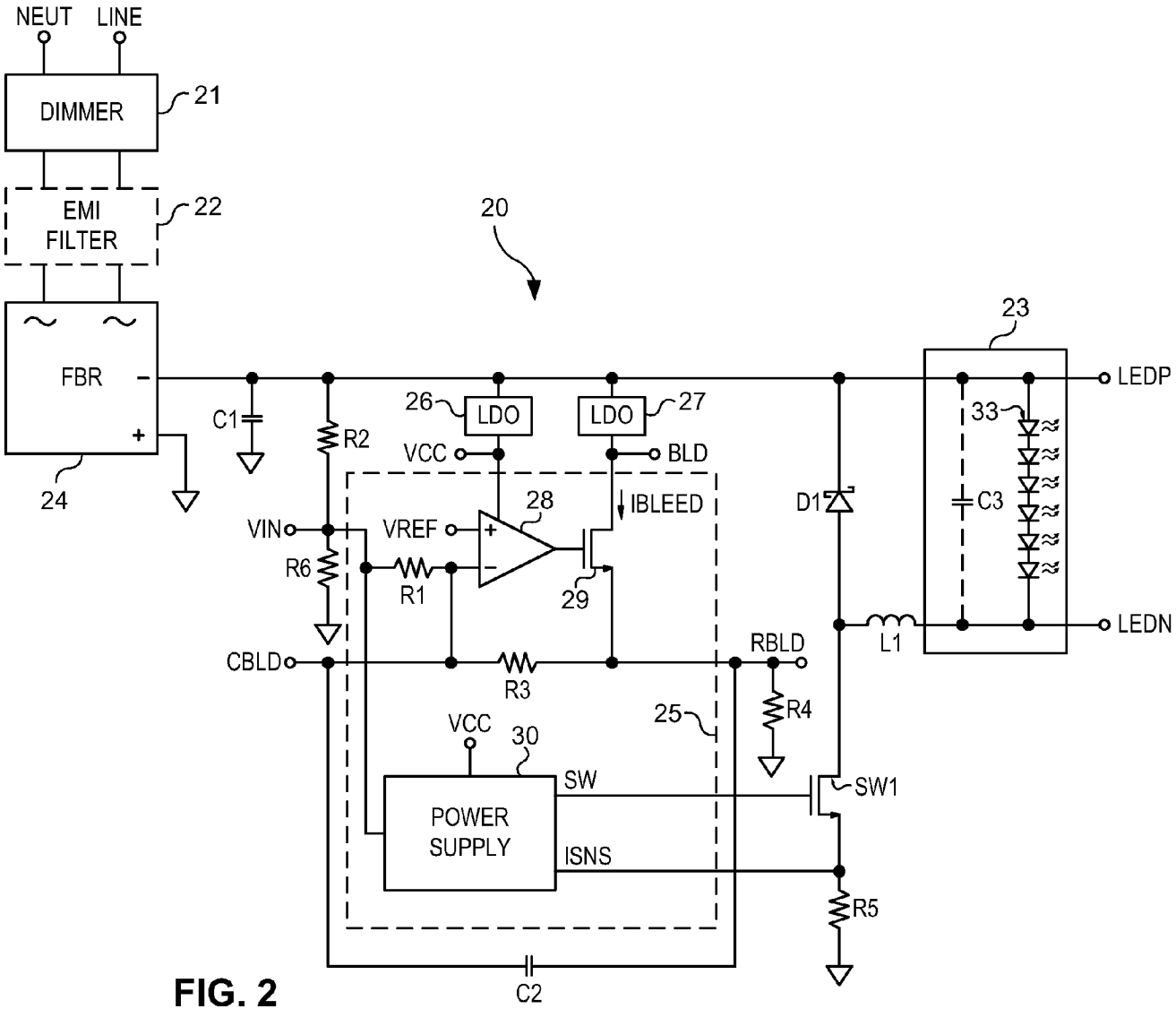
FIG. 2 is a circuit 20 that effectuates the graph of FIG. 1.

FIG. 2 shows a circuit that we have designed that effectuates the graph of FIG. 1. The AC line voltage applied to dimmer 21 is shown as having two inputs, a line voltage input LINE and a neutral input NEUT. Dimmer 21 typically likes to look into a purely resistive load, while an LED 33 is not a pure resistor. However, this can be compensated for. Dimmer 21 consumes power even when the lighting device 23 is off. This is the origination of the bleed current IBLEED. Even a basic triac dimmer 21 has some residual current. So-called smart dimmers 21 have quite a bit of residual current. The bleed current IBLEED does not contribute to activating the lighting device 23.

An optional EMI (electromagnetic interference) filter 22 can be inserted between dimmer 21 and driver circuit 20. When used, filter 22 helps to filter out unwanted electromagnetic energy. Rectifier 24 is typically but not necessarily a full bridge rectifier comprising four diodes in a standard bridge configuration. Lighting device 23 is shown as an array 33 of several LEDs connected in series, with an optional capacitor C3 connected in parallel across array 33. Capacitor C3 works in conjunction with smoothing inductor L1 to smooth the current going into the lighting device 23, and in particular, going into the LED array 33, making said current closely resemble a direct current. The output voltage across lighting device 23 is taken at two terminals, LEDP and LEDN, representing positive and negative polarities, respectively. The voltage at LEDP (VLEDP) is a function of how much dimming is being employed, and may or may not vary over a given time interval.

Capacitor C1, coupled between the positive output of rectifier 24 and ground, serves to filter out high frequency noise. The negative output of rectifier 24 is grounded. The bleed current control circuit 25 has an input voltage VIN, which is measured between resistors R2 and R6. VIN is a fixed fraction of VLEDP.

The negative terminal of operational amplifier (op amp) 28 is coupled to the negative output terminal of rectifier 24 via resistors R1 and R2. A reference voltage VREF is applied to the positive input terminal of op amp 28. A fixed control voltage VCC (the supply voltage to circuit 25) is applied to the control terminal of op amp 28. A first low dropout voltage regulator (LDO) 26 is coupled between the control terminal of op amp 28 and LEDP. The output terminal of op amp 28 is applied to a first terminal of a bipolar transistor or FET 29. When a FET is used, the output terminal of op amp 28 is applied to the gate of FET 29. In that case, the drain of FET 29 is applied through resistor R3 to the negative input terminal of op amp 28, and the source of FET 29 is coupled to a first terminal of a second low dropout voltage regulator (LDO) 27, referred to as terminal BLD in FIG. 2. IBLEED is measured at this terminal.

The second terminal of LDO 27 is coupled to LEDP and the negative output terminal of rectifier 24. For each LDO 26, 27, there is a relatively high voltage at its upper terminal and a relatively low fixed voltage at its lower terminal. Capacitor C2 is coupled between the negative input terminal of op amp 28, which is called terminal CBLD (capacitor bleed) in FIG. 2, and a terminal denominated RBLD (resistor bleed), which is coupled to the drain of FET 29. Capacitor C2 establishes the time constant over which the aforesaid time-averaging takes place.

A resistor R4 is coupled between RBLD and ground. R4 establishes IMAX. Power supply 30 provides power to control circuit 25. Op amp 28, transistor 29, resistors R1 and R3, and power supply 30 can be implemented in an integrated circuit 25.

Power supply 30 is typically a switch-mode (switching) power supply, since this type of power supply is smaller and more efficient than a conventional power supply. Voltage VCC is applied to the input power terminal of power supply 30. The SW (switch) terminal of power supply 30 is coupled to SW1, which can be a bipolar transistor or an FET. FIG. 2 shows the example where SW1 is an FET, in which case the SW terminal of power supply 30 is coupled to the gate of FET SW1. In this example, the ISNS (current sense) terminal of power supply 30 is coupled to the drain of FET SW1, and, via resistor R5, to ground. Resistor R5 regulates the current that is supplied to the LEDs 33. R5 is the sense resistor for SW1. The source of FET SW1 is coupled to a first terminal of diode D1, which may be a Schottky diode, and via inductor L1 to LEDN. The second terminal of diode D1 is coupled to LEDP.

Resistor R2 is coupled between the negative output of rectifier 24 and, via resistor R1, to the negative input terminal of op amp 28. The resistive bridge comprising resistors R2 and R6 serves to set VIN at a point that is optimal for the components within circuit 25, to stabilize VIN, and to establish VMAX.

Resistor R3, in conjunction with resistor R1, establishes the slope of the FIG. 1 curve, by the following equation:

$$V(RBLD)=R3*(VIN-VREF)/R1.$$

Figure 3:
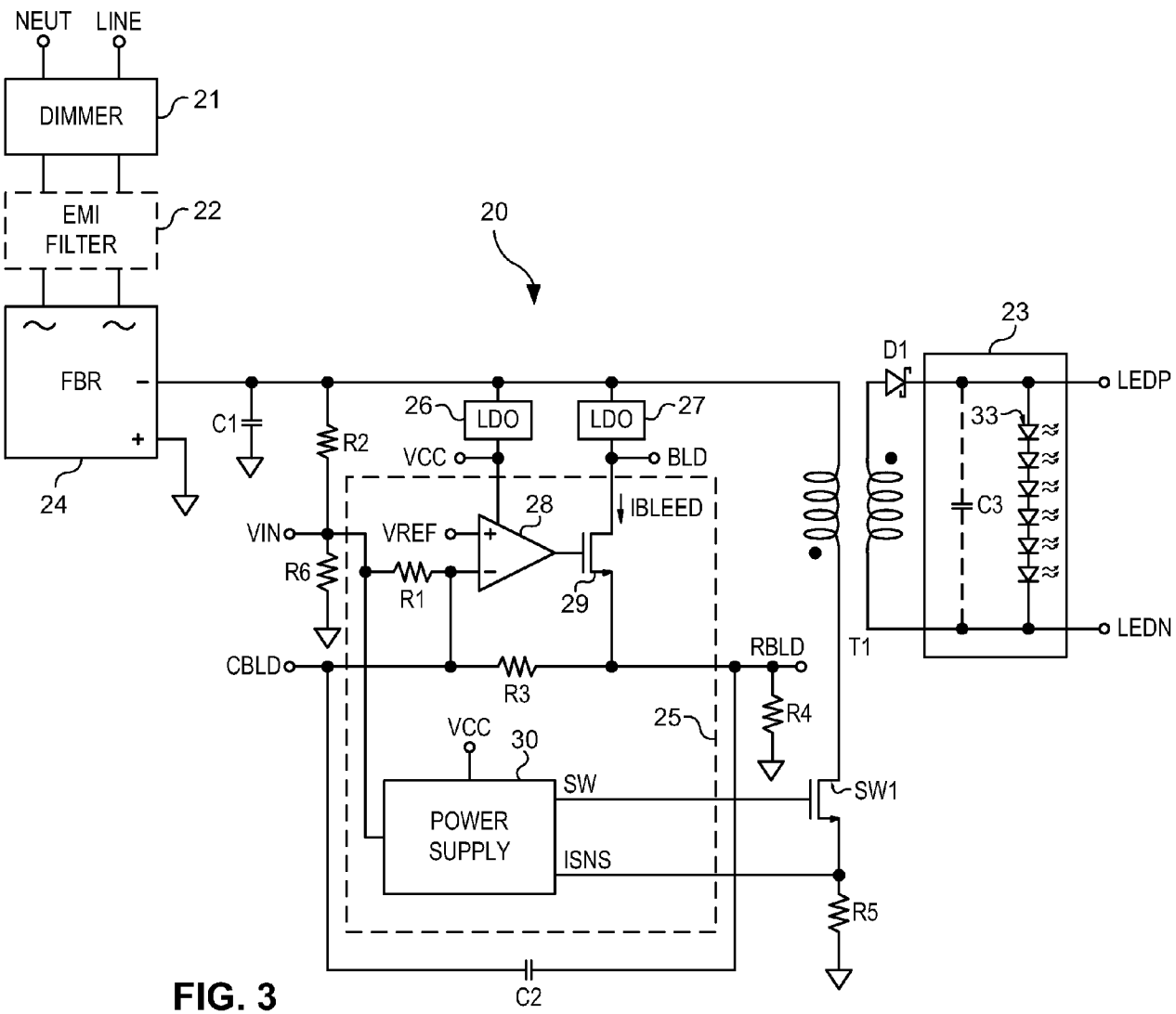
FIG. 3 is a circuit diagram of an alternative embodiment of the present invention in which a transformer T1 is used for isolation.

FIG. 3 illustrates an alternative isolated embodiment of the present invention, in which a transformer T1 takes the place of power inductor L1. The FIG. 3 embodiment is suitable for higher-end performance lighting applications, where electrical isolation is needed or desired, e.g., for reasons of safety. In FIG. 3, SW1 is located on the rectifier 24 side of transformer T1, while diode D1 is located on the load 23 side of transformer T1.

The above description is included to illustrate the operation of the preferred embodiments, and is not meant to limit the scope of the invention. The scope of the invention is to be limited only by the following claims. From the above discussion, many variations will be apparent to one skilled in the art that would yet be encompassed by the spirit and scope of the present invention.

What is claimed is:

1. A method for controlling bleed current in a driver circuit for a lighting device, said method comprising the steps of:

coupling a dimmer to an input of the driver circuit, wherein the dimmer consumes power even when the lighting device is not emitting light; and forcing the bleed current to be inversely proportional to the time-averaged voltage at said lighting device.

2. The method of claim 1 wherein the dimmer comprises a triac.

3. The method of claim 1 wherein the bleed current decreases continuously as a function of time-averaged voltage at said lighting device.

4. The method of claim 1 comprising the further step of:

inserting a rectifier between the dimmer and the driver circuit; wherein an output of the rectifier is used to adjust the bleed current drawn by the driver circuit.

5. The method of claim 1 wherein the lighting device comprises at least one LED.

6. The method of claim 1 wherein the forcing step is performed by an integrated circuit.

7. The method of claim 1 wherein the forcing step is performed by a circuit comprising an operational amplifier having an input coupled to the input of the driver circuit and an output coupled to an FET.

8. The method of claim 1 wherein IBLEED=IMAX−(IMAX/VMAX)*avg(VLEDP); where IBLEED is the bleed current;

IMAX is the maximum bleed current;

VMAX is the time-averaged voltage at the lighting device at which IBLEED=zero amperes; and avg(VLEDP) is the time-averaged voltage at the lighting device.

9. The method of claim 8 wherein VMAX is preselected to be less than the maximum voltage at the input of the driver circuit.

10. The method of claim 8 wherein IMAX is preselected to be greater than the standby current required by the dimmer.

11. The method of claim 8 wherein the current flowing through the driver circuit at some intermediate lighting device voltage between 0 volts and VMAX is sufficient for the dimmer to latch and hold.

12. Apparatus for controlling bleed current in a driver circuit for a lighting device, said apparatus comprising:

a lighting device;

coupled to the lighting device, a driver circuit for controlling the voltage and current supplied to the lighting device; and coupled to the driver circuit, a dimmer adapted to variably adjust brightness emanating from the lighting device; wherein the driver circuit comprises means for forcing the bleed current to be inversely proportional to the time-averaged voltage at said lighting device.

13. The apparatus of claim 12 wherein the dimmer comprises a triac.

14. The apparatus of claim 12 wherein the forcing means is adapted to cause the bleed current to decrease continuously as a function of time-averaged voltage at said lighting device.

15. The apparatus of claim 12 wherein the lighting device comprises an array of LEDs and a capacitor coupled in parallel with said array.

16. The apparatus of claim 12 wherein the forcing means comprises an integrated circuit.

17. The apparatus of claim 12 wherein the forcing means comprises an operational amplifier having a first input coupled to the input of the driver circuit and an output coupled to a first terminal of an FET.

18. The apparatus of claim 17 wherein the FET has a second terminal coupled to a first low dropout voltage regulator and a third terminal coupled via a resistor to a second input of the operational amplifier.

19. The apparatus of claim 18 wherein:

a second terminal of the first low dropout voltage regulator is coupled to the lighting device; and a control input of the operational amplifier is coupled to a first terminal of a second low dropout voltage regulator.

20. The apparatus of claim 19 wherein the second low dropout voltage regulator has a second terminal coupled to the lighting device.

* * * * *